US008702493B2

(12) United States Patent
Nores

(10) Patent No.: US 8,702,493 B2
(45) Date of Patent: Apr. 22, 2014

(54) SLOT MACHINE GAME WITH AWARD BASED ON ANOTHER MACHINE

(75) Inventor: Alvaro Nores, Buenos Aires (AR)

(73) Assignee: Etasse Limited, Alderney (GB)

( * ) Notice: Subject to any disclaimer, the term of this patent is extended or adjusted under 35 U.S.C. 154(b) by 1195 days.

(21) Appl. No.: 11/952,470

(22) Filed: Dec. 7, 2007

(65) Prior Publication Data

US 2009/0124328 A1 May 14, 2009

Related U.S. Application Data

(60) Provisional application No. 60/986,805, filed on Nov. 9, 2007.

(51) Int. Cl.
*A63F 13/00* (2006.01)

(52) U.S. Cl.
USPC ..... 463/20; 463/16; 463/17; 463/18; 463/19

(58) Field of Classification Search
USPC ..... 463/25–28, 40–42
See application file for complete search history.

(56) References Cited

U.S. PATENT DOCUMENTS

| | | | |
|---|---|---|---|
| 4,836,546 | A | 6/1989 | DiRe et al. |
| 5,033,744 | A | 7/1991 | Bridgeman et al. |
| 5,342,049 | A | 8/1994 | Wichinsky et al. |
| 5,401,023 | A | 3/1995 | Wood |
| 5,401,024 | A | 3/1995 | Simunek |
| 5,411,271 | A | 5/1995 | Mirando |
| 5,456,465 | A | 10/1995 | Durham |
| 5,511,781 | A | 4/1996 | Wood et al. |
| 5,676,371 | A | 10/1997 | Kelly et al. |
| 5,704,835 | A | 1/1998 | Dietz, II |
| 5,720,662 | A | 2/1998 | Holmes et al. |
| 5,769,716 | A | 6/1998 | Saffari et al. |
| 5,823,874 | A | 10/1998 | Adams |
| 5,833,537 | A | 11/1998 | Barrie |
| 5,947,821 | A | 9/1999 | Stone |
| 5,976,016 | A | 11/1999 | Moody et al. |
| 6,001,016 | A | 12/1999 | Walker et al. |
| 6,015,346 | A | 1/2000 | Bennett |

(Continued)

FOREIGN PATENT DOCUMENTS

| | | |
|---|---|---|
| EP | 1063622 | 12/2000 |
| EP | 1652562 | 5/2006 |

(Continued)

OTHER PUBLICATIONS

European Patent Office, Supplementary European Search Report for European Application No. EP 06 71 8145, report completed Apr. 30, 2010.

(Continued)

*Primary Examiner* — Ronald Laneau
*Assistant Examiner* — Justin Myhr
(74) *Attorney, Agent, or Firm* — McDonnell Boehnen Hulbert & Berghoff LLP

(57) ABSTRACT

A slot machine method, apparatus, and computer readable storage to implement a side wager for a slot machine which allows a player on a first machine to win bonus awards when a player on other (participating) machines wins a jackpot. The side wager activates the ability to win a bonus for a predetermined period of time or a predetermined number of spins on the other machines, or some other limiting factor.

15 Claims, 4 Drawing Sheets

(56) References Cited

U.S. PATENT DOCUMENTS 6,059,659 A * 5/2000 Busch et al. ..... 463/17
6,070,874 A 6/2000 Ivers
6,120,298 A 9/2000 Jenkins et al.
6,129,632 A 10/2000 Luciano
6,159,097 A 12/2000 Gura
6,174,235 B1 1/2001 Walker et al.
6,186,894 B1 2/2001 Mayeroff
6,193,606 B1 2/2001 Walker et al.
6,210,275 B1 4/2001 Olsen
6,224,483 B1 5/2001 Mayeroff
6,270,409 B1 8/2001 Shuster
6,287,197 B1 9/2001 Dickinson et al.
6,338,678 B1 1/2002 Seelig et al.
6,346,043 B1 2/2002 Colin et al.
6,347,996 B1 2/2002 Gilmore et al.
6,358,147 B1 3/2002 Jaffe et al.
6,390,473 B1 5/2002 Vancura et al.
6,394,899 B1 5/2002 Walker
6,413,161 B1 7/2002 Baerlocher et al.
6,425,824 B1 7/2002 Baerlocher et al.
6,450,888 B1 9/2002 Takase et al.
6,485,367 B1 11/2002 Joshi
6,547,242 B1 4/2003 Sugiyama et al.
6,554,283 B2 4/2003 Vancura et al.
6,575,831 B1 6/2003 Gonen et al.
6,595,854 B2 7/2003 Hughs-Baird et al.
6,601,850 B1 8/2003 Ross
6,604,740 B1 8/2003 Singer et al.
6,609,971 B2 8/2003 Vancura
6,609,974 B2 8/2003 Mead et al.
6,641,477 B1 11/2003 Dietz et al.
6,663,489 B2 12/2003 Baerlocher et al.
6,666,765 B2 12/2003 Vancura
6,669,559 B1 12/2003 Baerlocher et al.
6,695,696 B1 2/2004 Kaminkow
6,709,332 B2 3/2004 Adams
6,731,313 B1 5/2004 Kaminkow
6,752,396 B2 6/2004 Smith
6,761,632 B2 7/2004 Bansemer et al.
6,769,986 B2 8/2004 Vancura
6,780,103 B2 8/2004 Bansemer et al.
6,780,107 B2 8/2004 Baerlocher et al.
6,811,486 B1 11/2004 Luciano, Jr.
6,830,514 B2 12/2004 Meyer et al.
6,855,054 B2 2/2005 White et al.
6,860,810 B2 3/2005 Cannon et al.
6,863,606 B1 3/2005 Berg et al.
6,869,360 B2 3/2005 Marks et al.
6,884,165 B2 4/2005 Baerlocher
6,890,257 B2 5/2005 Baerlocher
6,896,260 B2 5/2005 Pierce
6,902,481 B2 6/2005 Breckner et al.
6,938,068 B1 8/2005 Kraft et al.
6,939,223 B1 9/2005 Jones
6,942,568 B2 9/2005 Baerlocher
6,942,571 B1 9/2005 McAllister et al.
6,950,993 B2 9/2005 Breinberg
6,964,416 B2 11/2005 McClintic et al.
6,966,836 B1 11/2005 Rush et al.
6,984,174 B2 1/2006 Cannon et al.
6,991,539 B2 1/2006 Pacey
6,997,805 B2 2/2006 Vancura
7,036,083 B1 4/2006 Zenith
7,056,210 B2 6/2006 Bansemer et al.
7,066,811 B1 6/2006 DeFrees-Parrott et al.
7,147,559 B2 12/2006 Englman
7,175,524 B2 2/2007 Bansemer et al.
7,175,527 B2 2/2007 Bryant
7,192,346 B2 3/2007 Mathis
7,252,589 B1 8/2007 Marks et al.
7,264,545 B2 9/2007 Maya et al.
7,275,989 B2 10/2007 Moody
7,326,115 B2 2/2008 Baerlocher
7,341,513 B2 3/2008 Cuddy et al.
7,364,506 B2 4/2008 Jaffe et al.
7,367,883 B2 5/2008 Gagnon
7,371,173 B2 5/2008 Gatto et al.
7,377,850 B2 5/2008 Shackelford et al.
7,393,278 B2 7/2008 Gerson et al.
7,470,193 B2 12/2008 Umezaki
7,534,168 B2 5/2009 Bennett et al.
7,559,836 B2 7/2009 Gerson et al.
7,585,219 B2 9/2009 Randall et al.
7,631,872 B2 12/2009 Roemer et al.
7,690,996 B2 4/2010 Iddings et al.
7,713,123 B2 5/2010 Gerson et al.
7,727,063 B2 6/2010 Walker et al.
7,753,790 B2 7/2010 Nguyen et al.
7,771,279 B2 8/2010 Miyamoto et al.
7,789,749 B2 9/2010 Bansemer et al.
7,819,748 B2 10/2010 Ajioka
7,846,015 B2 12/2010 Bansemer et al.
8,231,453 B2 7/2012 Wolf et al.
8,475,262 B2 7/2013 Wolf et al.
2001/0003709 A1 6/2001 Adams
2001/0009865 A1 7/2001 Demar et al.
2001/0031659 A1 10/2001 Perrie et al.
2002/0010017 A1 1/2002 Bennett
2002/0027323 A1 3/2002 Vancura et al.
2002/0043759 A1 4/2002 Vancura
2002/0045474 A1 4/2002 Singer et al.
2002/0049082 A1 4/2002 Bansemer et al.
2002/0049802 A1 4/2002 Bansemer et al.
2002/0052234 A1 5/2002 Adams
2002/0058545 A1 5/2002 Luciano
2002/0077165 A1 6/2002 Bansemer et al.
2003/0003980 A1 1/2003 Moody
2003/0013514 A1 1/2003 Cregan et al.
2003/0022711 A1 1/2003 Locke et al.
2003/0027619 A1 2/2003 Nicastro
2003/0027639 A1 2/2003 Peterson et al.
2003/0036423 A1* 2/2003 Vancura ..... 463/20
2003/0040355 A1 2/2003 Baerlocher
2003/0060276 A1 3/2003 Walker et al.
2003/0060278 A1 3/2003 Walker et al.
2003/0060281 A1 3/2003 Vancura
2003/0064782 A1 4/2003 Beaulieu et al.
2003/0064797 A1 4/2003 Jackson et al.
2003/0064800 A1 4/2003 Jackson et al.
2003/0092476 A1 5/2003 Fox
2003/0092480 A1 5/2003 White et al.
2003/0100361 A1* 5/2003 Sharpless et al. ..... 463/25
2003/0119576 A1 6/2003 McClintic et al.
2003/0119581 A1 6/2003 Cannon et al.
2003/0119756 A1 6/2003 McClintic et al.
2003/0125107 A1 7/2003 Cannon
2003/0130027 A1 7/2003 Aida
2003/0153375 A1 8/2003 Vancura
2003/0162584 A1 8/2003 Hughs-Baird et al.
2003/0162585 A1 8/2003 Bigelow, Jr. et al.
2003/0181231 A1 9/2003 Vancura et al.
2003/0186733 A1* 10/2003 Wolf et al. ..... 463/16
2003/0195027 A1 10/2003 Baerlocher et al.
2003/0195034 A1 10/2003 Dunaevsky
2003/0224849 A1 12/2003 Geiger
2004/0014517 A1 1/2004 Inoue
2004/0023715 A1 2/2004 Luciano, Jr.
2004/0036216 A1 2/2004 Vancura
2004/0048650 A1 3/2004 Mierau et al.
2004/0053657 A1 3/2004 Fiden et al.
2004/0053683 A1 3/2004 Hartl et al.
2004/0063483 A1 4/2004 Wolf et al.
2004/0072603 A1 4/2004 Shuster
2004/0092300 A1 5/2004 Gauselmann
2004/0116173 A1 6/2004 Baerlocher
2004/0121838 A1 6/2004 Hughs-Baird et al.
2004/0127280 A1 7/2004 Moody
2004/0152509 A1 8/2004 Hornik et al.
2004/0176157 A1 9/2004 Walker et al.
2004/0198490 A1 10/2004 Bansemer et al.
2004/0204233 A1 10/2004 Saffari et al.
2004/0209662 A1 10/2004 Wadleigh
2004/0219969 A1 11/2004 Casey et al.
2004/0235548 A1 11/2004 Benbrahim

(56) References Cited

U.S. PATENT DOCUMENTS

| | | | | |
|---|---|---|---|---|
| 2004/0235556 | A1 | 11/2004 | Flemming et al. | |
| 2004/0242316 | A1 | 12/2004 | Oles et al. | |
| 2005/0014551 | A1 | 1/2005 | Packes et al. | |
| 2005/0014557 | A1 | 1/2005 | Duhamel | |
| 2005/0014563 | A1 | 1/2005 | Barri | |
| 2005/0026664 | A1 | 2/2005 | Bansemer et al. | |
| 2005/0026679 | A1 | 2/2005 | Lucchesi et al. | |
| 2005/0032566 | A1 | 2/2005 | Baerlocher et al. | |
| 2005/0033711 | A1 | 2/2005 | Horvitz et al. | |
| 2005/0054416 | A1 | 3/2005 | Hostetler et al. | |
| 2005/0054430 | A1* | 3/2005 | Pitman et al. | 463/25 |
| 2005/0085285 | A1 | 4/2005 | Muskin | |
| 2005/0090307 | A1 | 4/2005 | Walker et al. | |
| 2005/0107154 | A1 | 5/2005 | Pacey | |
| 2005/0119040 | A1 | 6/2005 | Berman et al. | |
| 2005/0130737 | A1 | 6/2005 | Englman et al. | |
| 2005/0137007 | A1 | 6/2005 | Schaufelberger | |
| 2005/0153765 | A1 | 7/2005 | Shoostine | |
| 2005/0153770 | A1 | 7/2005 | Vancura | |
| 2005/0164794 | A1 | 7/2005 | Tahara | |
| 2005/0176494 | A1 | 8/2005 | Thomas | |
| 2005/0181866 | A1 | 8/2005 | Baerlocher | |
| 2005/0187005 | A1 | 8/2005 | Rose | |
| 2005/0187023 | A1 | 8/2005 | Miyamoto et al. | |
| 2005/0202864 | A1 | 9/2005 | Duhamel et al. | |
| 2005/0202869 | A1 | 9/2005 | Miyamoto et al. | |
| 2005/0215311 | A1 | 9/2005 | Hornik et al. | |
| 2005/0266916 | A1 | 12/2005 | Sato et al. | |
| 2005/0277469 | A1 | 12/2005 | Pryzby et al. | |
| 2006/0003831 | A1 | 1/2006 | Falciglia, Sr. | |
| 2006/0019738 | A1 | 1/2006 | Baerlocher et al. | |
| 2006/0030398 | A1 | 2/2006 | Hornik | |
| 2006/0046818 | A1 | 3/2006 | Goins | |
| 2006/0046853 | A1 | 3/2006 | Black | |
| 2006/0063584 | A1 | 3/2006 | Brill et al. | |
| 2006/0073863 | A1 | 4/2006 | Hagiwara | |
| 2006/0073878 | A1 | 4/2006 | Shackelford et al. | |
| 2006/0121972 | A1 | 6/2006 | Walker et al. | |
| 2006/0121978 | A1 | 6/2006 | Hornick et al. | |
| 2006/0160595 | A1 | 7/2006 | Gerson et al. | |
| 2006/0160614 | A1 | 7/2006 | Walker et al. | |
| 2006/0172791 | A1 | 8/2006 | Wolf | |
| 2006/0181028 | A1 | 8/2006 | Benator | |
| 2006/0183536 | A1 | 8/2006 | Gagner et al. | |
| 2006/0189377 | A1 | 8/2006 | Gomez et al. | |
| 2006/0189378 | A1 | 8/2006 | Aoki | |
| 2006/0205483 | A1 | 9/2006 | Meyer et al. | |
| 2006/0240890 | A1 | 10/2006 | Walker et al. | |
| 2006/0247035 | A1* | 11/2006 | Rowe et al. | 463/26 |
| 2006/0252494 | A1 | 11/2006 | Gerson et al. | |
| 2006/0252495 | A1 | 11/2006 | Gerson et al. | |
| 2006/0264255 | A1 | 11/2006 | Borissov | |
| 2007/0060254 | A1* | 3/2007 | Muir | 463/16 |
| 2007/0060314 | A1* | 3/2007 | Baerlocher et al. | 463/25 |
| 2007/0077988 | A1 | 4/2007 | Friedman | |
| 2007/0087805 | A1 | 4/2007 | Taylor | |
| 2007/0102877 | A1 | 5/2007 | Personius et al. | |
| 2007/0161424 | A1 | 7/2007 | Gatto et al. | |
| 2007/0167217 | A1* | 7/2007 | Kaminkow et al. | 463/20 |
| 2007/0171192 | A1 | 7/2007 | Seo et al. | |
| 2007/0190495 | A1 | 8/2007 | Kendir et al. | |
| 2007/0281774 | A1 | 12/2007 | Khal | |
| 2007/0287523 | A1 | 12/2007 | Esses et al. | |
| 2008/0045295 | A1 | 2/2008 | Walker et al. | |
| 2008/0076513 | A1 | 3/2008 | Esses et al. | |
| 2008/0076518 | A1 | 3/2008 | Yoshizawa | |
| 2008/0102923 | A1 | 5/2008 | Esses et al. | |
| 2008/0113769 | A1 | 5/2008 | Montero et al. | |
| 2008/0119260 | A1 | 5/2008 | Nores | |
| 2008/0119261 | A1 | 5/2008 | Heymann | |
| 2008/0153570 | A1 | 6/2008 | Esses et al. | |
| 2008/0167116 | A1 | 7/2008 | Gerson | |
| 2008/0214292 | A1 | 9/2008 | Bryant et al. | |
| 2008/0234032 | A1 | 9/2008 | Brunet de Courssou et al. | |
| 2008/0274798 | A1 | 11/2008 | Walker et al. | |
| 2008/0310302 | A1 | 12/2008 | Detwiler et al. | |
| 2008/0318660 | A1 | 12/2008 | Nores | |
| 2009/0005145 | A1 | 1/2009 | White | |
| 2009/0029773 | A1 | 1/2009 | Cherry | |
| 2009/0029779 | A1 | 1/2009 | Murase et al. | |
| 2009/0061982 | A1 | 3/2009 | Brito | |
| 2009/0064000 | A1 | 3/2009 | Garbow et al. | |
| 2009/0082080 | A1 | 3/2009 | Bennett et al. | |
| 2009/0093296 | A1 | 4/2009 | Gerson et al. | |
| 2009/0104977 | A1 | 4/2009 | Zielinski | |
| 2009/0124328 | A1 | 5/2009 | Nores | |
| 2009/0124352 | A1 | 5/2009 | Gerson | |
| 2009/0286586 | A1 | 11/2009 | Heymann et al. | |
| 2010/0004048 | A1 | 1/2010 | Gerson et al. | |
| 2010/0029376 | A1 | 2/2010 | Hardy et al. | |
| 2010/0029378 | A1 | 2/2010 | Gerson et al. | |
| 2010/0048284 | A1 | 2/2010 | Jaffe | |
| 2010/0210356 | A1 | 8/2010 | Losica | |
| 2010/0240456 | A1 | 9/2010 | Goto et al. | |
| 2010/0331071 | A1 | 12/2010 | Uchiyama et al. | |
| 2011/0281627 | A1 | 11/2011 | Lutnick et al. | |
| 2012/0052939 | A1 | 3/2012 | Lutnick et al. | |

FOREIGN PATENT DOCUMENTS

| | | | |
|---|---|---|---|
| GB | 2148037 | | 5/1985 |
| GB | 2335524 | | 9/1999 |
| WO | 2006076424 | A3 | 7/2006 |
| WO | 2006076462 | A3 | 7/2006 |
| WO | 2007076514 | A3 | 7/2007 |
| WO | 2007143704 | A3 | 12/2007 |
| WO | 2008039413 | A3 | 4/2008 |
| WO | 2008051518 | A3 | 5/2008 |
| WO | 2008057188 | | 5/2008 |
| WO | 2008057201 | A3 | 5/2008 |
| WO | 2008060472 | A3 | 5/2008 |
| WO | 2008060473 | A3 | 5/2008 |
| WO | 2009032130 | A3 | 3/2009 |

OTHER PUBLICATIONS

Illinois Lottery Office of the Superintendent Game Rules, Downloaded from the World Wide Web at http://webarchive.org/web/w0061109031843/http://www.illinoislottery.com/subsections/OnLineRules.htm, downloaded on Sep. 28, 2011 as archived on Nov. 9, 2006.

International Searching Authority, Notification of Transmittal of the International Search Report and the Written Opinion of the International Searching Authority, or the Declaration, for International Application No. PCT/US07/23656, mailed on Aug. 25, 2008.

International Searching Authority, Notification of Transmittal of the International Search Report and the Written Opinion of the International Searching Authority, or the Declaration, for International Application No. PCT/US07/74030, mailed on Sep. 26, 2008.

International Searching Authority, Written Opinion of the International Searching Authority (PCT Rule 43 bis.1), for International Application No. PCT/US07/23658, mailed on Sep. 22, 2008.

United States Patent and Trademark Office, Office Action for U.S. Appl. No. 11/873,740, dated Jun. 9, 2008.

"Nintendogs" instruction booklet by Nintendo of America, Inc., http://www.nintendo.com/consumer/gameslist/manuals/DS_Nintendogs.pdf, Jul. 15, 2005.

International Searching Authority of WIPO, PCT Written Opinion of the International Searching Authority, for International Application No. PCT/US07/22425, mailing date Jul. 24, 2008.

International Searching Authority of WIPO, PCT Written Opinion of the International Searching Authority for International Application No. PCT/US08/10156, mailed on Jun. 25, 2009.

The International Bureau of WIPO, PCT International Preliminary Report on Patentability, for International Application PCT/US2006/000346, report issued on Jul. 8, 2008.

The International Bureau of WIPO, PCT International Preliminary Report on Patentability for International Application PCT/US2006/001034, issued on Nov. 19, 2007.

(56) References Cited

OTHER PUBLICATIONS

The International Bureau of WIPO, PCT International Preliminary Report on Patentability, for International Application PCT/US2006/062630, report issued on Jul. 1, 2008.
The International Bureau of WIPO, PCT International Preliminary Report on Patentability, for International Application PCT/US2007/20589, report issued on Mar. 31, 2009.
The International Bureau of WIPO, PCT International Preliminary Report on Patentability, for International Application PCT/US2007/022425, report issued on May 12, 2009.
The International Bureau of WIPO, PCT International Preliminary Report on Patentability, for International Application PCT/US2007/022426, report issued on Apr. 28, 2009.
The International Bureau of WIPO, International Preliminary Report on Patentability, for International Application PCT/US2007/022775, report issued on Apr. 28, 2009.
The International Bureau of WIPO, PCT International Preliminary Report on Patentability, for International Application PCT/US2007/023657, report issued on May 12, 2009.
Government of Macao Special Administrative Region, International-Type Search Report and Office Action for application No. 1/0004388(880), cover sheet dated Apr. 17, 2009.
Wikipedia, "Wheel of Fortune," http://en.wikipedia.org/wiki/Wheel_of_Fortune, printed Dec. 8, 2008.
International Searching Authority, PCT Written Opinion of the International Searching Authority (PCT Rule 43 bis.1), for International Application No. PCT/US07/23656, mailed on Aug. 25, 2008.
The International Bureau of WIPO, PCT International Preliminary Report on Patentability, for International Application PCT/US2007/023658, report issued on May 12, 2009.
International Searching Authority, Notification of Transmittal of the International Search Report and the Written Opinion of the International Searching Authority, or the Declaration, for International Application No. PCT/US07/22775, dated Aug. 15, 2008.
U.S. Appl. No. 11/558,405, filed Nov. 9, 2006, inventor Matias Montero and entitled System and Method for allowing piggyback wagering.
U.S. Appl. No. 12/773,847, filed May 5, 2010.
Sony Pictures Television—Wheel of Fortune 20th Anniversary—downloaded from http://webarchive.org/web/20030624010929/http://www.wheeloffortune.com/, Jun. 24, 2003.
Instructions for "Clue Classsic Detective Game," Hasbro, Inc. copyright 1986, available at http://www.hasbro.com/common/instruct/clueins.pdf, last accessed on Jun. 24, 2013, 4 pages.

* cited by examiner

SLOT MACHINE GAME WITH AWARD BASED ON ANOTHER MACHINE

CROSS REFERENCE TO RELATED APPLICATIONS

This application claims benefit to provisional application 60/986,805, filed Nov. 9, 2007, which is incorporated by reference herein in its entirety.

Application is also related to the following ten applications identified by their application number, all ten applications are incorporated by reference herein in their entireties: Ser. No. 11/035,691 ("Slot Machine Game that Allows Player to Purchase Reel Respins"); Ser. No. 11/326,125 ("Slot Machine Bonus Game"); Ser. No. 11/337,960 ("Slot Machine with Skill Aspect"); Ser. No. 11/558,405 ("System and Method for Allowing Piggyback Wagering"); Ser. No. 11/609,315 ("System and Method for Allowing Piggyback Wagering"); Ser. No. 11/459,253 ("Slot Machine Bonus Game"); Ser. No. 11/558,564 ("System and Method for Administering a Progressive Jackpot Limited to a Bonus Round"); Ser. No. 11/678,050 ("Slot Machine Game With Additional Features"); Ser. No. 11/764,689 ("Slot Machine Game with Additional Award Indicator"); and Ser. No. 11/776,508 ("Slot Machine Game With User Selectable Themes"). All ten of these applications are incorporated by reference herein in their entireties for all purposes. Any and all features of any of these applications can be combined with each other and with any feature(s) described herein.

BACKGROUND OF THE INVENTION

1. Field of the Invention

The present inventive concept relates to a system, method, and computer readable storage, for providing additional award opportunities to slot machine games.

2. Description of the Related Art

Slot machine games are a billion dollar industry. The current three or five reel machines have been around for a long time and some players may find current game play monotonous.

What is needed is a slot machine with additional slot machine features which will generate more excitement for players and/or more revenue as well.

SUMMARY OF THE INVENTION

It is an aspect of the present general inventive concept to provide additional features to slot machine games.

The above aspects can also be obtained by a method that includes (a) receiving an additional wager from a first player on a first slot machine to win a potential bonus award on a predetermined number of plays on other slot machines; (b) playing the first slot machine, by the first player; (c) playing the predetermined number of plays on other slot machines by other players; and (d) determining that one of the other slot machines during the predetermined number of plays awarded a jackpot to its respective player and if so, then awarding a bonus award to the first player.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
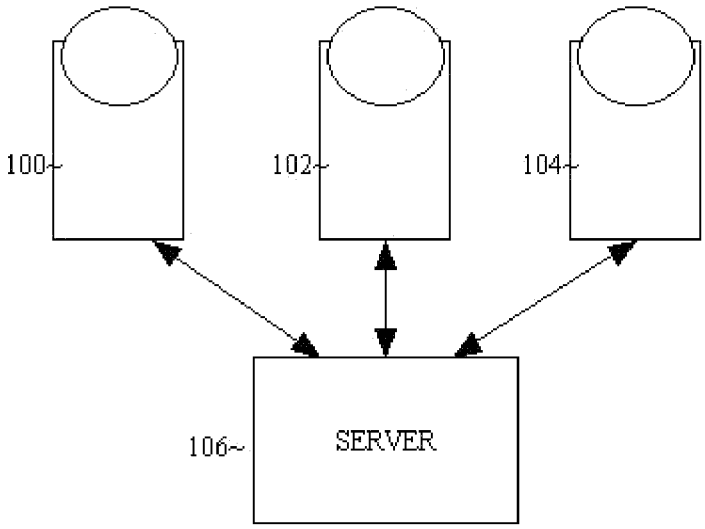
FIG. 1 is a block diagram illustrating a bank of slot machines connected to a server implementing a bonus jackpot, according to an embodiment.

Reference will now be made in detail to the presently preferred embodiments of the invention, examples of which are illustrated in the accompanying drawings, wherein like reference numerals refer to like elements throughout.

Embodiments of the invention relate to slot machine games, where a player typically places a main wager, presses a button to spin the reels, the reels each stop at a random position. Payouts are then determined by comparing all paylines played to a predetermined set of winning combinations, and then the determined payouts, if any, are awarded to the player based on the main wager. Additional features can augment the excitement of a player and may also result in increased action for the casino.

Slot machines can award jackpots when a machine hits a predetermined rare combination. For example, if a spin on a three reel machine results in three jackpot symbols, that machine might win a fixed jackpot (e.g., $100,000) or a progressive jackpot (the amount is not predetermined but is based on a continuously increasing pool).

If a player wins a jackpot, the other players at the casino may get envious. An embodiment of the present inventive concept allows for a player to pay for the ability to share in jackpots that other players may receive on their machines. For example, a player can pay a "jackpot ante" of $1, and then for the next 100 plays (or any amount) of a participating machine (other machines not being played by the player), if such participating machine hits a jackpot, then the player wins a bonus. In this example, each penny the player wagers accounts for one participating machine. Thus, if the player pays the $1, and 100 plays of participating machines occur (without any jackpots being issued), then the player no longer is eligible to receive any further bonuses based on others' machines unless he pays another jackpot ante. Thus, a "jackpot ante" is the term used to describe an additional wager (in addition to the main wager) that a player places on a slot machine which does not affect an award received on that player's machine based on the main wager based on a final random reel symbol combination but instead will allow the player to potentially earn awards when other players on participating machines win jackpots.

A participating machine is a machine hooked up to the system wherein a player who pays the jackpot ante has an opportunity to win a bonus award when a participating machine wins a jackpot. Some slot machines in the casino may not be participating machines and thus their play has no effect on the player who makes the jackpot ante. For example, a particular bank of machines (they can be the same kind of machine or not) can all be participating machines.

Further, a player that makes a jackpot ante should typically not affect awards of other players on other machines. The bonus award used to pay a jackpot ante can be paid for by the jackpot ante itself. The jackpot ante can also optionally go into a separate jackpot ante progressive for jackpot ante players, and when one player hits a jackpot, the separate jackpot ante progressive can be shared among qualifying players (players who made a jackpot ante bet which qualified them for an award on a machine hitting a jackpot).

FIG. 1 is a block diagram illustrating a bank of slot machines connected to a server implementing a bonus jackpot, according to an embodiment.

Slot machines 100, 102, 104 are all participating machines in a bonus jackpot which is administered by server 106. Thus, a player playing machine 100 can pay a jackpot ante, and if machines 102 or 104 hit a jackpot, then the player at machine 100 can be awarded the same (or lesser or more) jackpot that was earned by the other machine.

For example, the player playing machine 100 can pay $5 to have five chances (spins) on other machines to win awards. For example player at machine 102 plays, then player at machine 104 players, then player at machine 104 plays, then player at machine 102 plays, then player at machine 104 plays. No player wins a jackpot. Thus, the player playing machine 100 has lost his or her $5. If now player at machine 102 plays, the player playing machine 100 will not be eligible for an award if the player at machine 102 hits a jackpot since the player playing machine 100 has already used his or her five chances. In order for the player playing machine 100 to now earn a bonus from another machine, the player playing machine 100 would have to make another jackpot ante wager.

In this way, a player must pay for each potential bonus award the player could earn on another machine. For example, if each spin on another machine cost the player $1 to earn a bonus award, then for the next 1,000 spins on participating machines, the player must pay $1,000.

When the player's jackpot ante is all used up (all spins paid for on other machines have been played), the player can be prompted to make another jackpot ante. The player can also choose to have the jackpot ante automatically debited from his or her machine so that the player will not miss any opportunities to earn a bonus award while other participating machines are playing.

Figure 2:
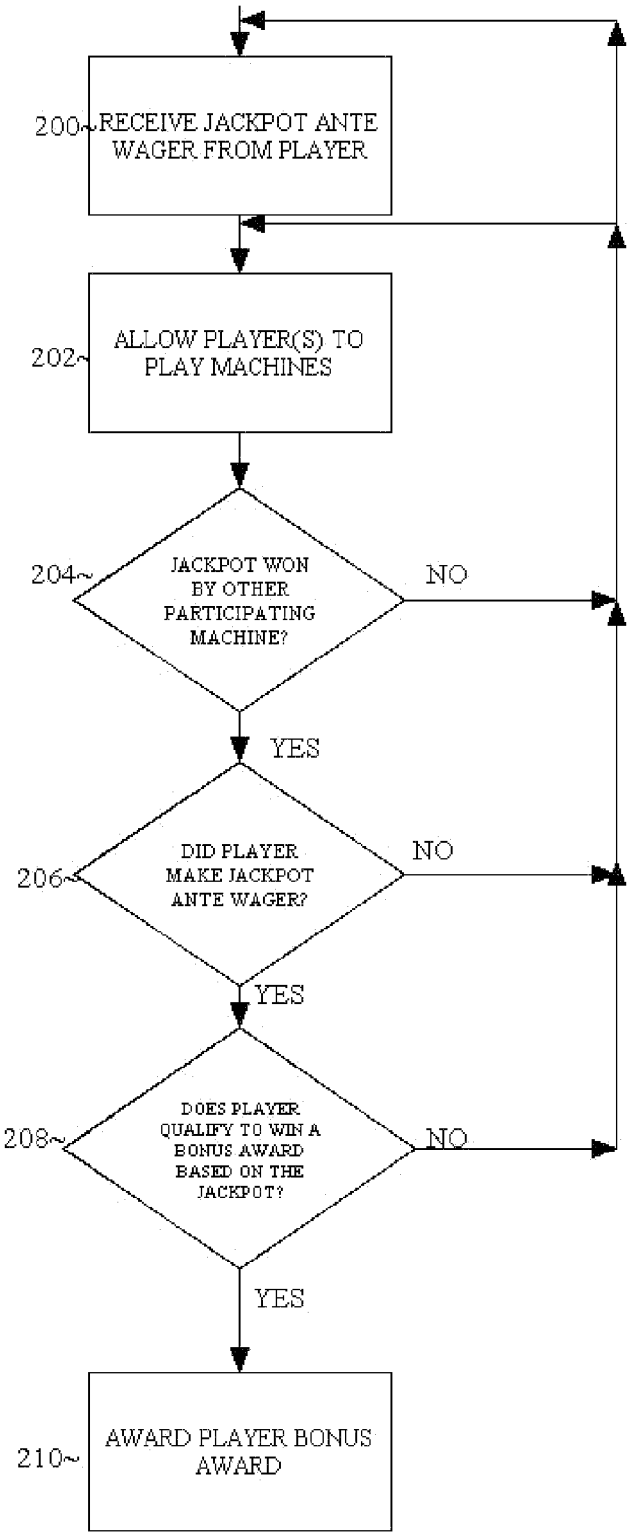
FIG. 2 is a flowchart illustrating an exemplary method of implementing a method to award bonus awards, according to an embodiment.

FIG. 2 is a flowchart illustrating an exemplary method of implementing a method to award bonus awards, according to an embodiment.

The method can begin with operation 200, which receives a jackpot ante from a player. This can be done by the player pressing a button on a slot machine indicating the player's desire to place the jackpot ante. The player may also indicate how much he wishes to place on the jackpot ante, or the amount the player can place on the jackpot ante can be predetermined and fixed. The player can decide whether to make (or not to make) the jackpot ante wager. Of course, if the player does not make the jackpot ante wager then the player would not be eligible (unless he or she was already eligible) to win a bonus if another participating machine wins a jackpot.

From operation 200, the method can proceed to operation 202, which allows players to play the machines. The player plays his or her machine, while other players play their respective (other) participating machines. The player, in addition to any jackpot ante wager made, would also make standard wagers on the slot machine in order to be able to spin the reels and win awards, as known in the art. Thus, the jackpot ante wager is an auxiliary side wager which the player can place if the player wants the ability to win bonus awards based on jackpots on other participating machines. Machines can be linked up to the network/server and can be configured to be participating machines. Participating machines are typically indicated as such on the machine so that players know which machines are involved. Other machines may or may not be participating machines, depending on the casinos preferences.

From operation 202, the method can proceed to operation 204, which determines whether a jackpot was hit by an other participating machine. If not, then the method can return to operation 200 which can receive an additional jackpot ante wager from the player or alternatively from operation 204 the method can return to operation 202.

If the determination in operation 204 determines that an other machine has won a jackpot, then the method can proceed to operation 206, which determines whether the player made the jackpot ante wager (in operation 200). If the player did not make the jackpot ante wager in operation 200, then the player will not be eligible to win a bonus based on the jackpot won by the other participating machine and the method would then return to either operation 200 or 202.

If in operation 206 it is determined that the player made the jackpot ante wager in operation 200, then the method can proceed to operation 208, which determines whether the player qualifies to win a bonus based on the jackpot won by the other participating machine. This determination would be made based on a limiting criteria of the jackpot ante wager. For example, the jackpot ante wager can apply to only the next X (e.g., 100) spins on any of the other participating machines. If, after the player has made the jackpot ante wager, more than 100 spins have been made (and the player has not made another jackpot ante wager), then the player would not qualify to win a bonus award based on the jackpot. If, after the player has made the jackpot ante wager, less than 101 spins have been made, then the player would qualify to win a bonus award based on the jackpot.

Similarly, if the limiting factor is a time duration (e.g., one hour), then in order for the player to win a bonus award based on the jackpot, the jackpot would have to have occurred within one hour from the time the last jackpot ante wager was made. If so, the player would win a bonus award, if not, the player would not win an award (because the jackpot was awarded after the window of time that the jackpot ante was active had expired).

Thus, if the determination in operation 208 determines that the player does not qualify to win a bonus award based on the jackpot (e.g., the player's jackpot ante wager had expired and was not made again in time), then the method can return to either operation 200 or 202.

If the determination in operation 208 determines that the player does qualify to win a bonus award based on the jackpot, then the method can proceed to operation 210, which awards the player a bonus award. The method can then return to operations 200 or 202.

In a further embodiment, the player's status as to whether he qualifies for a bonus award based on a jackpot on another machine can be automatically monitored. For example, if the player pays $1 to earn a bonus award on the next 100 spins of the other machines, and then 100 spins of the other machines occur, the player will then be shut out of earning additional bonus awards. In such a case, the player's machine can automatically deduct another $1 from the player's credit meter. In this manner, the player will never miss out on earning a bonus award if another player earns a jackpot. The player can indicate to the machine (for example by pressing a button) whether the player consents to such automatic debiting.

Figure 3:
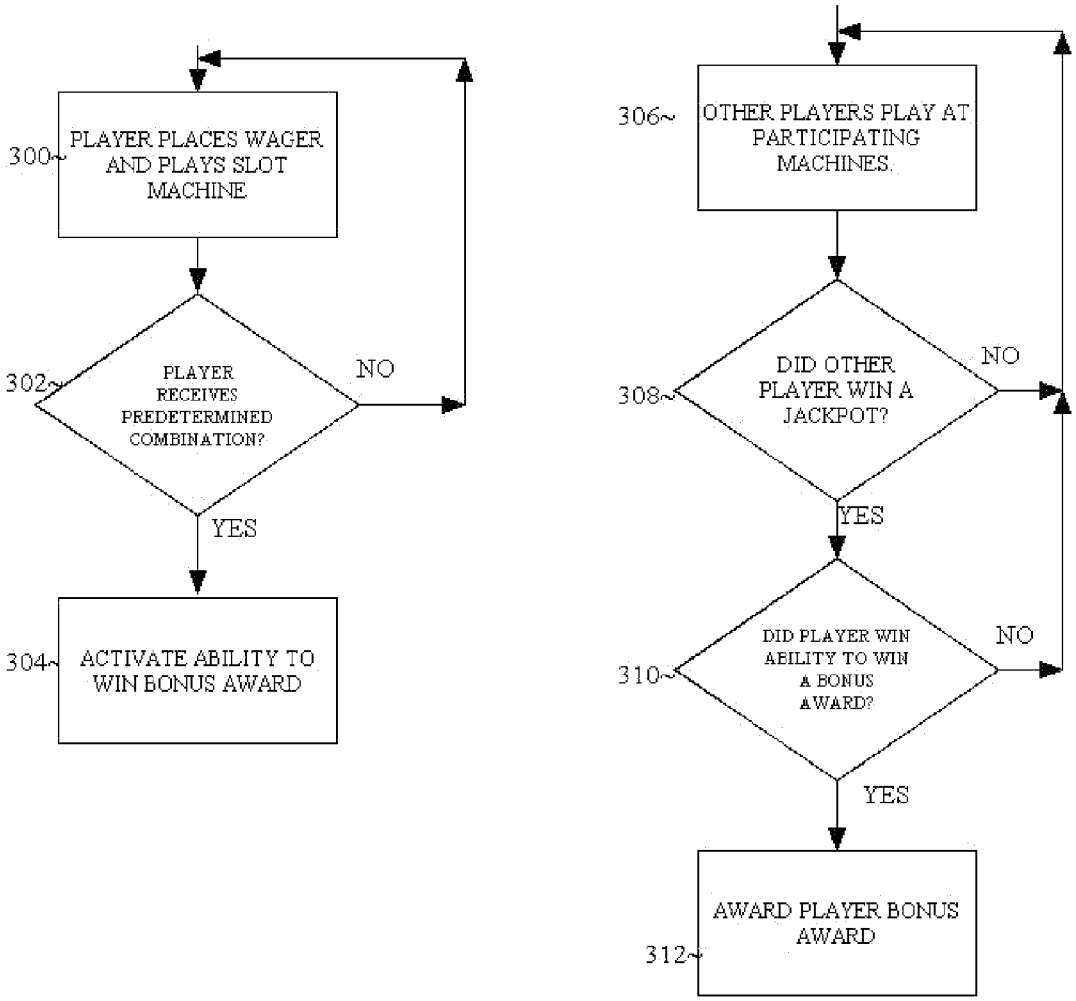
FIG. 3 is a flowchart illustrating an exemplary method of allowing a player to win bonus award eligibility, according to an embodiment.

FIG. 3 is a flowchart illustrating an exemplary method of allowing a player to win bonus award eligibility, according to an embodiment.

The method can begin with operation 300, wherein the player places a wager and plays a slot machine by spinning the reels which come to a stop at a random symbol position. This can be done as known in the art.

From operation 300, the method can proceed to operation 302, which determines whether the random symbol position comprises a predetermined winning combination. If not, then the method can return to operation 300.

If in operation 302, it is determined that the random symbol position comprises a predetermined winning combination, then the method can proceed to operation 304, which activates an ability to win a bonus award. This can be similar to making the jackpot ante wager from FIG. 2, but does not require a separate bet made by the player (in other words the player has won the ability to earn a bonus on jackpots on other participating machines). The ability to win a bonus award activated in operation 304 can have a limiting factor (as described with respect to FIG. 2), e.g., a limited number of spins on other participating machines or a limited duration.

While the player is playing his or her machine in operations 300, 302, and 304, other players can be playing their respective participating machines as well in operation 306.

In operation 308, it is determined whether an other player playing a respective participating machine wins a jackpot. If not, then the method can return to operation 306. If so, then the method can proceed to operation 310.

In operation 310, it is determined whether the player won an ability to win a bonus award. Thus, if the player had previously reached operation 304 then the player had won the ability to win a bonus award. A determination can also be made as to whether the ability the player won to earn the bonus award (in operation 304) is still in force when the other player won the jackpot (operation 308). For example, if the other player won the jackpot when less than a predetermined (or random) number of spins on participating machines had been played (after the player reached operation 304), then the player would win the bonus award. If the other player won the jackpot when more than a predetermined (or random) number of spins on participating machines had been played (after the player reached operation 304), then the player would not win the bonus award. Any limiting factor can be used (e.g., number of spins, time period, day, etc.)

If the player has won the ability to win a bonus award, and this ability did not expire, then the method can proceed to operation 312, which awards the player a bonus award.

An example of an embodiment of a method described herein is as follows. John is playing a $2 slot machine (wagers $2 at a time). John also wagers $1 on the jackpot ante, which earns him the right to collect a bonus if a participating machine (there can be many such machines, such as 10-20 or any other number) wins a jackpot of 7-7-7 which pays $1,000 on that machine. If a participating machine hits 7-7-7 John will win $500 (while the player at that machine wins $1,000). The $1 jackpot ante qualifies John for a potential award for 50 spins of the other participating machines (the 50 spins can accrue in any manner, for example 50 individual machines can spin once, or 25 machines can each spin twice, or 30 machines can spin once, 7 machines can spin twice, and 2 machines can spin 3 times for a total of 50 spins, or any other combination). What matters is that there were a predetermined (in this example 50) number of possibilities for John to earn an award based on the other machines. The number can also be random (e.g., a random number from 30-60) as opposed to a fixed predetermined number (e.g., 50). The other machines are being played by other players and 50 spins occur without any player hitting 7-7-7. Thus, John has lost his $1 jackpot ante without winning a bonus award.

John wagers another $1 on the jackpot ante to try again for another 50 spins of the other machines. In the meantime, John is still wagering $2 a pull on his own machine. Whether John himself wins or loses on his own machine is irrelevant as far as any potential bonus award he may earn goes. Whether the other players win or lose is also irrelevant as far as any potential bonus award that John can earn, except for when the other players hit 7-7-7 (which in this example is configured to win John a bonus award when he eligible for one). After 30 spins of the other machines, one of the other participating machines now hits 7-7-7. John's machine now pays him $500 because the other participating machine hit the 7-7-7. In an alternative embodiment, John can win $1,000 for the 7-7-7 (the same award that player hitting the jackpot would earn).

If John hit 7-7-7, then other players playing participating machines that made the jackpot ante and were eligible to win a bonus based on John's play (e.g., their jackpot ante had not expired) would earn their own bonus award. But other players' bonus awards would not affect John's winnings (John would win the $1,000 for hitting the 7-7-7). John would typically not care what other players were paid.

Furthermore, instead of an other player on a participating machine having to win a jackpot in order for a player to win a bonus award, the other player can instead only need to win an award greater than a predetermined amount. For example, if an other player wins an award of $100 or greater, than a player placing a jackpot ante (which considers the other player a participating machine), would win a bonus based on the award that the other player has won. Higher awards won by other plays would typically result in higher awards won by the player earning the bonus award from the jackpot ante.

In a further embodiment, a plurality of machines on a casino floor may qualify as participating machine. A first player playing a slot machine can choose which of the plurality of machines the player wishes to use as participating machines. Thus, if a participating machine (selected by the player) hits a jackpot (defined as either a top award on that machine or an award greater than a predetermined threshold or a particular set of predetermined awards), then the first player wins a bonus award. If a machine that is not selected by the first player as participating machine (even though the machine could have been), then the first player will not win a bonus award. A player can select machines which are participating machines by viewing a map of machines on an output device on a slot machine and touching which machines he or she wishes to include as participating machines. Of course, the more participating machines that the first player includes, the quicker a number of spins for the jackpot ante will be used up. Thus, the more machines the first player wishes to select as participating machines, the more expensive it will be for the first player to maintain the jackpot ante so that the player would not miss out on any bonus awards for any of the participating machines.

In another embodiment, a player can make a jackpot ante without having to be at a typical slot machine. For example, a casino can offer such a bet independent of a slot machine. For example, at a keno stand or automated kiosk, a player can purchase a jackpot ante wager for a plurality of participating machines. For example, a player can pay $100 to win a bonus award if any machine on the casino floor (or only certain participating machines) hit a jackpot (or predetermined award(s)) on a particular day (or for a predetermined number of spins by other players). The player can also make such a wager over the Internet. The duration of time can also be as long as a year (or even more). For example, a player can place a wager that a jackpot will be hit at particular casino (or group of casinos) on all (or only participating) machines, and if the jackpot is not hit, then the player loses the wager, and if the jackpot is hit, then the player wins an award for the wager.

Figure 4:
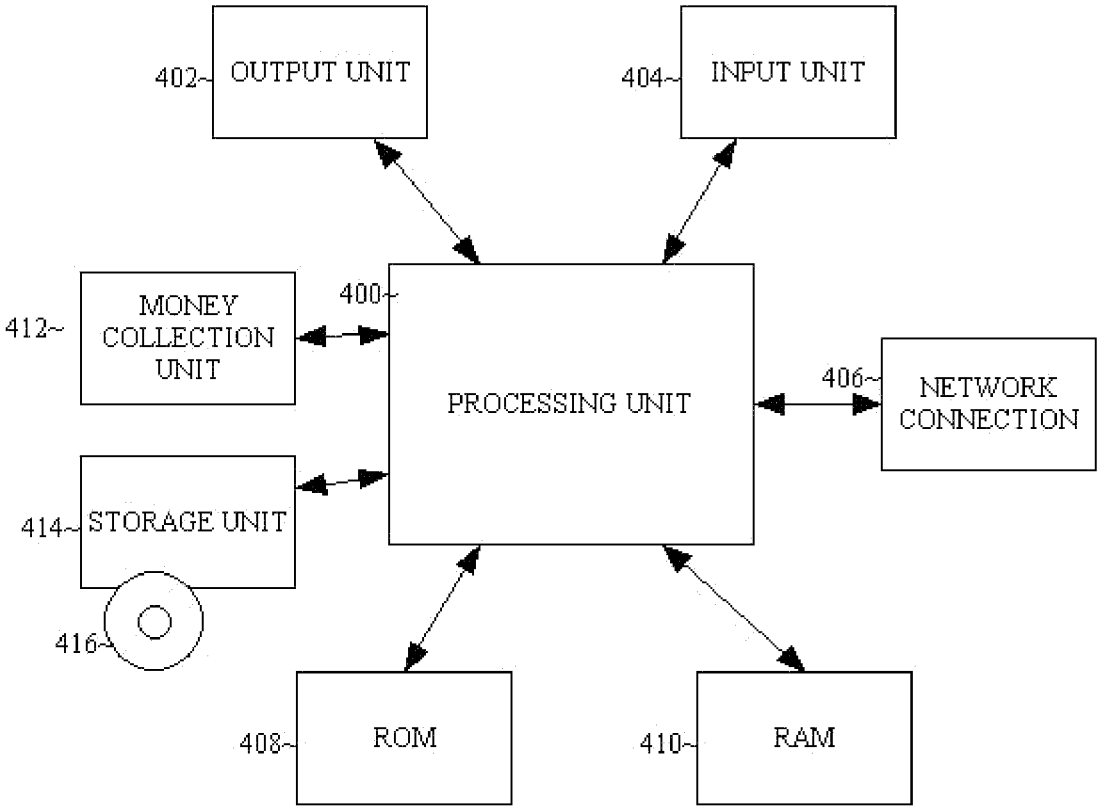
FIG. 4 is an exemplary block diagram of exemplary hardware that can be used to implement methods described herein, according to an embodiment.

FIG. 4 is a block diagram of one example of hardware that can be used to implement the method, according to an embodiment.

A processing unit 400 (which can comprise a microprocessor and related components) can be connected to an output unit 402 (e.g., LCD or touch screen, etc.), an input unit 404 (e.g. a touch screen, keyboard, buttons, etc.), a network connection 406 (e.g. connection to a casino server or the Internet or other communication network), a ROM 408, a RAM 410, and any other hardware known in the art needed to implemented a digital version of the game (not pictured).

The game can also be served to a remote client playing at an online casino over a computer communications network (such as the internet). A money collection unit 412 can be used to receive cash (e.g., a bill acceptor), or other payment from such as electronic payment and credit. A storage unit 414 can be a CD-ROM drive, a DVD-ROM drive, or any device that can read a computer readable storage medium. A CD-ROM 416 (or any other type of computer readable storage medium) can be read by the storage unit 414 and can contain data, assets, programs, etc., in order to implement the methods described herein on an electronic gaming machine such as the one illustrated in FIG. 4.

Further, the order of any of the operations described herein can be performed in any order and wagers can be placed/resolved in any order. Any operation described herein can also be optional. Any embodiments herein can also be played in electronic form and programs and/or data for such can be stored on any type of computer readable storage medium (e.g. CD-ROM, DVD, disk, etc.) The bonus round described herein can be played on an electronic gaming device or in association with a mechanical slot reel by attaching the electronics (including a touch screen) to the mechanical slot machine so that the bonus round can be implemented.

The descriptions provided herein also include any hardware and/or software known in the art and needed to implement the operations described herein. All components illustrated herein may also optionally communicate with any other illustrated or described component.

Further, the methods described herein can be applied to any type of slot machine, whether mechanical (reeled) or video slots, or a combination thereof.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method for awarding a bonus award at a slot machine, the method comprising:

receiving, at a server from a first slot machine being played by a first player, a jackpot ante and a selection of a set of other slot machines, wherein receiving the selection comprises receiving a selection of one or more individual slot machines independent of the jackpot ante, wherein receiving the jackpot ante and the selection of the set of other slot machines qualifies the first player as being eligible, during a predetermined time period that occurs after the server receives the jackpot ante and the selection of the set of other slot machines, to win at least a portion of a bonus award to be awarded if a jackpot award is won at a slot machine among the set of other slot machines during the predetermined time period that occurs after the server receives the jackpot ante and the selection of the set of other slot machines, wherein receiving the jackpot ante and the selection to qualify the first player as being eligible to win at least a portion of the bonus award to be awarded if the jackpot award is won at a slot machine among the set of other slot machines during the predetermined time period occurs prior to any play of a slot machine among the set of slot machines during the predetermined time period, and wherein each slot machine of the set of other slot machines is played by a player other than the first player;

the set of other slot machines being played during the predetermined time period that occurs after the server received the jackpot ante; and determining, using the server, that a slot machine among the set of other slot machines awarded a jackpot award to its respective player, for a play of the slot machine among the set of other slot machines during the predetermined time period, and, using the server, responsively awarding at least a portion of the bonus award to the first slot machine being played by the first player, wherein the bonus award and the jackpot award are awarded from separate pools.

2. The method as recited in claim 1, further comprising:

the server automatically determining whether the first slot machine being played by the first player qualifies to earn the bonus award on a next spin of one of the other slot machines, and if not, then the server automatically receiving another additional wager from the first slot machine being played by the first player.

3. The method as recited in claim 1, wherein if a jackpot is won via playing the first slot machine, then a second slot machine, that is one of the other slot machines and that is used to place an additional wager to win a potential award on a predetermined number of plays on other slot machines including the first slot machine, wins a bonus award because playing the first slot machine resulted in the winning of a jackpot.

4. A method for awarding a bonus award, the method comprising:

receiving, at a server from a first casino machine operated by a first bettor and connected to the server, a jackpot ante and a selection of a set of other casino machines, wherein receiving the selection comprises receiving a selection of one or more individual casino machines independent of the jackpot ante, wherein receiving the jackpot ante and the selection of the set of other casino machines qualifies the first bettor as being eligible, during a predetermined time period that occurs after the server receives the jackpot ante and the selection of the set of other casino machines, to win at least a portion of a bonus award to be awarded if a jackpot award is won at a casino machine among the set of other casino machines during the predetermined time period that occurs after the server receives the jackpot ante and the selection of the set of other casino machines, wherein receiving the jackpot ante and the selection to qualify the first bettor as being eligible to win at least a portion of the bonus award to be awarded if the jackpot award is won at the casino machine among the set of other casino machines prior to any play of a casino machine among the set of casino machines during the predetermined time period, wherein each casino machine of the set of other casino machines is played by a respective bettor other than the first bettor, and wherein the first casino machine is not among the set of other casino machines; and determining, using the server, that a casino machine among the set of casino machines, during the predetermined time period, was awarded a jackpot award for a game played at that casino machine, and, using the server, responsively awarding at least a portion of the bonus award to the first casino machine operated by the first bettor, wherein the bonus award and the jackpot award are awarded from separate pools.

5. The method as recited in claim 4, wherein the first casino machine operated by the first bettor is not a slot machine.

6. The method as recited in claim 5, wherein the first casino machine operated by the first bettor is an automated kiosk or a keno stand.

7. The method as recited in claim 5, wherein the first casino machine operated by the first better provides the wager to the server via the Internet.

8. A method for awarding a bonus award at a slot machine, the method comprising:

receiving, by a server, a wager from a first slot machine being played by a first player;

spinning, by the server, reels on the first slot machine, wherein the spinning reels stop at a first random combination that matches a predetermined winning combination;

paying, by the server, a first award to the first slot machine in response to the first random combination matching the predetermined winning combination;

determining, by the server, that the first random combination comprises a bonus trigger combination and responsively activating, by the server, an ability for the first player to win a bonus award during any spin of a number of spins occurring on a set of slot machines not including the first slot machine;

monitoring, by the server while the ability for the first player to win the bonus award during the number of spins occurring on the set of slot machines not including the first slot machine is still in force, the number of spins occurring on the set of slot machines not including the first slot machine;

determining, by the server, a slot machine of the set of slot machines hits a jackpot during one of the number of spins;

awarding, by the server, a jackpot award to the slot machine of the set slot machines that hits the jackpot; and awarding, by the server to the first slot machine being played by the first player, a bonus award in response to the server determining the ability for the first player to win the bonus award during any spin of the number of spins occurring on the set of slot machines is still in force when the slot machine of the set of slot machines hits the jackpot.

9. The method of claim 8, wherein the number of spins equals a number randomly selected from a range of numbers.

10. The method of claim 8, wherein the number of spins equals a fixed predetermined number.

11. The method of claim 8, further comprising:

receiving, by the server from the first slot machine, a jackpot ante that qualifies the first player for the ability for the first player to win the bonus award during the number of spins occurring on the set of slot machines not including the first slot machine.

12. The method of claim 8, wherein the set of slot machines not including the first slot machine comprises multiple slot machines.

13. The method of claim 12, wherein the number of spins accrues by each of the multiple slot machines spinning an equal number of times.

14. The method of claim 12, wherein the number of spins accrues, in part, by two slot machines of the multiple slot machines spinning different numbers of times.

15. The method of claim 8, wherein each slot machine of the set of slot machines is selected by the first player as belonging to the set of slot machines.

* * * * *